US012808094B2

(12) United States Patent
Shah

(10) Patent No.: US 12,808,094 B2
(45) Date of Patent: Nov. 24, 2026

(54) METHOD FOR PROCESSING FIBROUS MATTER FROM WASTE MATERIAL

(71) Applicant: Shikha Shah, Ahmedabad (IN)

(72) Inventor: Shikha Shah, Ahmedabad (IN)

( * ) Notice: Subject to any disclaimer, the term of this patent is extended or adjusted under 35 U.S.C. 154(b) by 201 days.

(21) Appl. No.: 18/035,928

(22) PCT Filed: Nov. 9, 2021

(86) PCT No.: PCT/IN2021/051059
§ 371 (c)(1),
(2) Date: May 9, 2023

(87) PCT Pub. No.: WO2022/097175
PCT Pub. Date: May 12, 2022

(65) Prior Publication Data

US 2024/0018696 A1 Jan. 18, 2024

(51) Int. Cl.

| | |
|---|---|
| ***D01G 11/00*** | (2006.01) |
| ***D01G 1/10*** | (2006.01) |
| ***D01G 5/00*** | (2006.01) |
| ***D01G 9/00*** | (2006.01) |
| ***D01G 13/00*** | (2006.01) |
| ***D06M 10/02*** | (2006.01) |
| ***D06M 16/00*** | (2006.01) |
| ***D06M 101/06*** | (2006.01) |
| ***D21B 1/02*** | (2006.01) |

(52) U.S. Cl.
CPC ..... *D01G 11/00* (2013.01); *D01G 1/10* (2013.01); *D01G 5/00* (2013.01); *D01G 9/00* (2013.01); *D01G 13/00* (2013.01); *D06M 10/02* (2013.01); *D06M 16/003* (2013.01); *D21B 1/02* (2013.01); *D06M 2101/06* (2013.01); *D10B 2201/00* (2013.01)

(58) Field of Classification Search
CPC . D01G 11/00; D01G 1/10; D01G 5/00; D01G 13/00; Y02W 30/64; Y02W 30/66; D06M 10/02; D06M 16/003; D10B 2201/00; D21B 1/02
USPC ..... 28/100, 102, 103; 19/107, 296; 8/115.51
See application file for complete search history.

(56) References Cited

U.S. PATENT DOCUMENTS

| | | | |
|---|---|---|---|
| 6,378,179 | B1 | 4/2002 | Hirsch |
| 9,663,895 | B2 | 5/2017 | Nunn et al. |
| 2011/0094691 | A1 | 4/2011 | Nunn |

FOREIGN PATENT DOCUMENTS

| | | | |
|---|---|---|---|
| CN | 102071509 | B | 10/2012 |
| WO | 2020014308 | A1 | 1/2020 |

*Primary Examiner* — Camie S Thompson
(74) *Attorney, Agent, or Firm* — Jose Cherson Weissbrot

(57) ABSTRACT

A method 100 for processing fibrous matter from a waste material involves obtaining 101 the waste material, trimming 102 the waste material, pre-treating 104, second mechanical treatment 106, washing 108, first chemical treatment 110 with an enzyme and water solution, draining 112 the enzyme and water solution, heating 114 to obtain a fiber cake, providing 116 controlled shockwaves, a second chemical treatment 118, hydro-extracting 120 fiber cake, opening 122 the fiber cake, drying 124, pre-conditioning and softening 126, mechanically treating and segregating 128, softening 129, processing 130 to obtain a sliver and spinning 132 the sliver to obtain a product.

14 Claims, 2 Drawing Sheets

METHOD FOR PROCESSING FIBROUS MATTER FROM WASTE MATERIAL

TECHNICAL FIELD

The present disclosure relates to a method of processing fibrous material to obtain a product. More particularly, the present disclosure relates to a fibrous matter obtained from a waste material for utilizing the same for industrial purposes.

BACKGROUND

Fibers are thin filaments which are employed to manufacture other materials such as clothes, rugs, mattress, insulation, composite etc. Fibers are either natural or man-made. There are different sources from which fibers are obtained. In case of natural fibres, it can mainly come from fibres textile plants or animals like cotton, flax from plants and wool, mohair, silk from animals. In case of man-made fibers there have been various source including trees for regenerated cellulose like viscose and synthetics like polyester from fossil fuels. It has been noted that the traditional means of spinnable fibres are causing environmental distress and are falling short of the increasing demand. The world uses around 110 million tons of fibres each year for textiles. 62% are synthetics majorly polyester which is nothing but plastic and major source of microplastics. As it is by-product of fossil fuel industry, with the rising awareness against the climate impact of the industry, the future of polyester production can be under jeopardy. Around 25% is cotton which is now majorly GMO is nature and is infamous for its high water and pesticides consumption. Around 7% is man-made cellulose like Viscose which is unfortunately still majorly coming for trees leading to de-forestation and hazardous hefty chemical usage for processing. All this clearly suggests an urgent need for new alternative materials.

Two sources of natural fibers and processing thereof to meet this demand have been identified:

1. The first is lignocellulosic waste. Millions of tons of lignocellulosic waste as a part of agriculture waste, processing waste etc. For example, the left out bast part of crops including but not limited to pineapple, hemp oil seed (not same as hemp textile crop), waste to jute processing units, cotton stalks, linseed, banana, kenaf, and wild grass nettle.
2. The other is bast textile crops. A very small percentage of world's usage includes bast fibres like from hemp textile crop, Jute crop, Flax textile crop etc. One of the key reasons of they being a small percentage is also because of the lower processability of the fiber. For example, Jute can only be used for low value applications or high-count yarn as in packaging sacks. Improving the quality of raw materials can increase the applications. One of the other reasons is that these fibres can need a different processing infrastructure in case of spinning and weaving than most of the used textile infrastructure, reducing the convenience for adoption of these materials by the textile manufacturing hubs. Making this form of fibers more suitable to different manufacturing systems can further increase the adoptability of these fibers.

Above mentioned fibers undergo extraction from the respective sources, followed by processing. The processing can differ from fiber to fiber and can involve improving the quality of the fibers to make them industrially fit or as per the project requirements.

However, the existing or conventional processes have different kinds of shortcomings:

1. They are not suitable for multiple kinds of lignocellulosic fibers. These processes work only with one or a few kinds of fibers requiring different production lines and high dependance on one or few kinds of raw materials.
2. The above reduces the economic viability and availability of raw materials. Further, increases the risk of the fall of supply chain as it is dependent on selected seasonal crops, leads to non-agile, rigid manufacturing system and hurdles scalability as the production line cannot be replicated with ease in different geographies.
3. They also yield a low-quality fiber that maybe suitable for paper or for non-woven but not spinning. If suitable, can only have low yarns count, low blend percentage, compromised functionalities such as low strength, high imperfections, high fibrillation etc.
4. The available processes are not eco-friendly, are expensive, and highly error prone due to the precision required and are not scalable. They also require high capital and operational investment.
5. Some of these processes do not work with finer fibers and yarn counts and their end products have low dyeability, color fastness, and fail to provide the natural feel of cellulose.

Most importantly, none of the above-mentioned methods are researched enough to work seamlessly with multiple kinds of lignocellulosic waste and control the parameters to achieve the process. None of the above methods can assure consistent output and scalable replication of the production lines across the world.

However, in the methods available as of now, products obtained have low tensile strength, inconsistent length, and irregular alignment of the fibers which affects the quality of the fibers when extracted and grouped in barns, rolls, or bales. Therefore, the fibrous matter after extracted from the various sources need to be processed to make the fibers industrially fit.

Even though the conventional fibers are easier to handle, and existing technologies can do that, fiber crops need to be planted in order to produce fibers per se, block the land that can be utilized to meet the growing demand of the food industry as the world population keeps booming. Furthermore, the amount of water required to process conventional fibers such as cotton, jute, silk etc. is very high. In a world where freshwater content keeps decreasing by the day, it is essential to reduce water consumption for traditional and commercial processes.

Many of the conventional methods available as of now involve regeneration of the fibrous matter, which is cumbersome, unsustainable, and resource heavy. In addition, each of the methods provides predefined output of the processed fibrous matter which leads to wastage of the fibrous matter. Further, some conventional methods employ only chemical, mechanical, or enzymatic treatment to the fibrous matter. Whereas, when used in combination they can yield much better results.

SUMMARY OF THE INVENTION

In view of the foregoing, a method (100) for processing fibrous matter from a waste material is provided.

In an aspect, the method (100) for processing fibrous matter from a waste material is provided. The method comprising, obtaining (101) the waste material. Trimming (102) the obtained waste material from step (101) by a first mechanical treatment, to obtain a plurality of trimmed fibers of optimum length ranging from 20 mm-200 mm on an average. Pre-treating (104) the plurality of trimmed fibers to obtain an impurity free trimmed fibrous matter. Providing a second mechanical treatment (106) to the fibrous matter obtained at step (104). Washing (108) the obtained fibers at step (106) with pressurized fluid at 0.5-20 bar to obtain a densely packed fiber. Providing a first chemical treatment (110) to the densely packed fibers obtained at step (108) with an enzyme and water solution. Draining (112) the enzyme and water solution from the fibers obtained at step (110) and refilling the container with water in a specific ratio. Heating (114) the refilled container at a temperature of 60-140 degree Celsius at 3-11 bar in a mixture of chemical and water to obtain a fiber cake. Providing (116) controlled shock waves to the fiber cake and optionally providing a second chemical treatment (118) to the obtained fiber cake at step (116). Hydro-extracting (120) a chemically treated fiber cake obtained at step (118). Opening (122) the hydro-extracted fiber cake. Drying (124) the opened fibers. Pre-conditioning and softening (126) the dried fibers. Mechanically treating and segregating (128) the fibers obtained at step (126). Softening (129) the treated fibers using lubricating agents. Processing (130) the softened fiber into a clean and parallel sliver and spinning (132) the obtained sliver to obtain a product. In another aspect, the method (100) further comprises a dyeing and a stabilizing step that can be done before hydro-extraction (120).

In yet another aspect of the invention, the method (100) further comprises blending at step (128) with other natural fibers comprising cotton, wool, jute, rayon, silk, hemp, alpaca fiber, recycled fibers, synthetic fiber, lyocell or other spinnable fibers.

In another aspect of the invention, in the method (100), the waste materials are selected from the group comprising bales, rolls, hanks, vegetable, plant, non-textile hemp, jute waste, palm waste, textile waste, lignocellulosic materials, wheat straw, rice straw, bagasse, cotton stalk, retted stalks, retted leaves and non-retted stalks.

In another aspect of the invention, in the method (100), the first mechanical (102) treatment is carried out from a group of machines selected from a manual cutting machine, round knife cutting machine, straight knife cutting machine, band knife cutting machine, die cutting machine, notcher machine, drill cutting machine, computerized cutting machine, laser cutting machine, water jet cutting machine, rib cutting machine, air jet cutting machine, ultrasonic cutting machine, and plasma torch cutting machine.

In another aspect of the invention, in the method (100), the enzyme at step (110) is selected from a group of enzymes comprising laccases, peroxidases, cellulases, pectinases, hemicellulases, amylase, xylanase, or cellullosomes.

In another aspect of the invention, in the method (100), the chemical treatment is carried out for 0.5-72 hours. In another aspect of the invention, in the method (100), drying (124) is done by radio frequency, steam, electric heating to reducing the moisture to 10-30%.

In another aspect of the invention, in the method (100), mechanical treatments (128) are carried out by a dual carding machine, a mono or single carding machine, a tandem carding machine, a Schubert & Sulzer super carding machine, a roller and clearer carding machine, a stationary flat carding machine, or revolving flat carding machine or a breaker card or hard waste opening machine and/or fibre cleaners or openers or segregators or blow room actions.

In another aspect of the invention, the method (100), further comprises cutting and bailing if needed after step (130).

In another aspect of the invention, the method (100), wherein processing (130) includes cleaning, parallelly arranging, reducing inconsistency of fiber by removing highly varied fibers, and removing short and weak fibers.

The method further comprises classifying the softened and preconditioned fibers obtained after step (126) on the basis of the physical and chemical properties thereof, using mechanical segregation methods.

In another aspect of the invention, the method (100), wherein the product consists of woven products, non-woven products, knitted products, composites, nano fibers and micronized fibers.

In another aspect of the invention, another method (200) for processing fibrous matter from a waste material to obtain a product is provided.

The method (200) involves obtaining (101) the waste material. Trimming (102) the obtained waste material from step (101) by a first mechanical treatment, to obtain a plurality of trimmed fibers of optimum length, ranging from 100 mm-200 mm on an average. Pre-treating (104) the plurality of trimmed fibrous matter to obtain an impurity free trimmed fibrous matter. Providing a second mechanical treatment (106) to the fibers obtained at step (104). Washing (108) the obtained fibers at step (106) with pressurized fluid at 0.5-20 bar to obtain a densely packed fibers. Providing a first chemical treatment (110) to the densely packed fibers obtained at step (108) with an enzyme and water solution. Draining (112) the enzyme and water solution from the fibers obtained at step (108) and refilling the container with water in a specific ratio. Heating (114) the refilled container at a temperature of 60-140 degree Celsius at 3-11 bar in a mixture of chemical and water to obtain a fiber cake. Providing (116) controlled shock waves to the fiber cake. Optionally, providing a second chemical treatment (118) to the obtained fiber cake at step (116). Dyeing (202) the fiber cake obtained at step (118). Stabilizing (204) the dyed product obtained at step (202). Hydro-extracting (120) the stabilized product obtained at step (204). Opening (122) the hydro-extracted fiber cake. Drying (124) the opened fibers. Pre-conditioning and softening (126) the dried fibers. Mechanically treating and segregating (128) the fibers obtained at step (126). Softening (129) the treated fibers using lubricating agents. Processing (130) the softened fiber into a clean and parallel sliver, and spinning (132) the obtained sliver to obtain a product.

BRIEF DESCRIPTION OF DRAWINGS

The drawing/s mentioned herein disclose exemplary embodiments of the claimed invention. Other objects, features, and advantages of the present invention will be apparent from the following description when read with reference to the accompanying drawing.

To facilitate understanding, like reference numerals have been used, where possible to designate like elements common to the figures.

DETAILED DESCRIPTION

Figure 1:
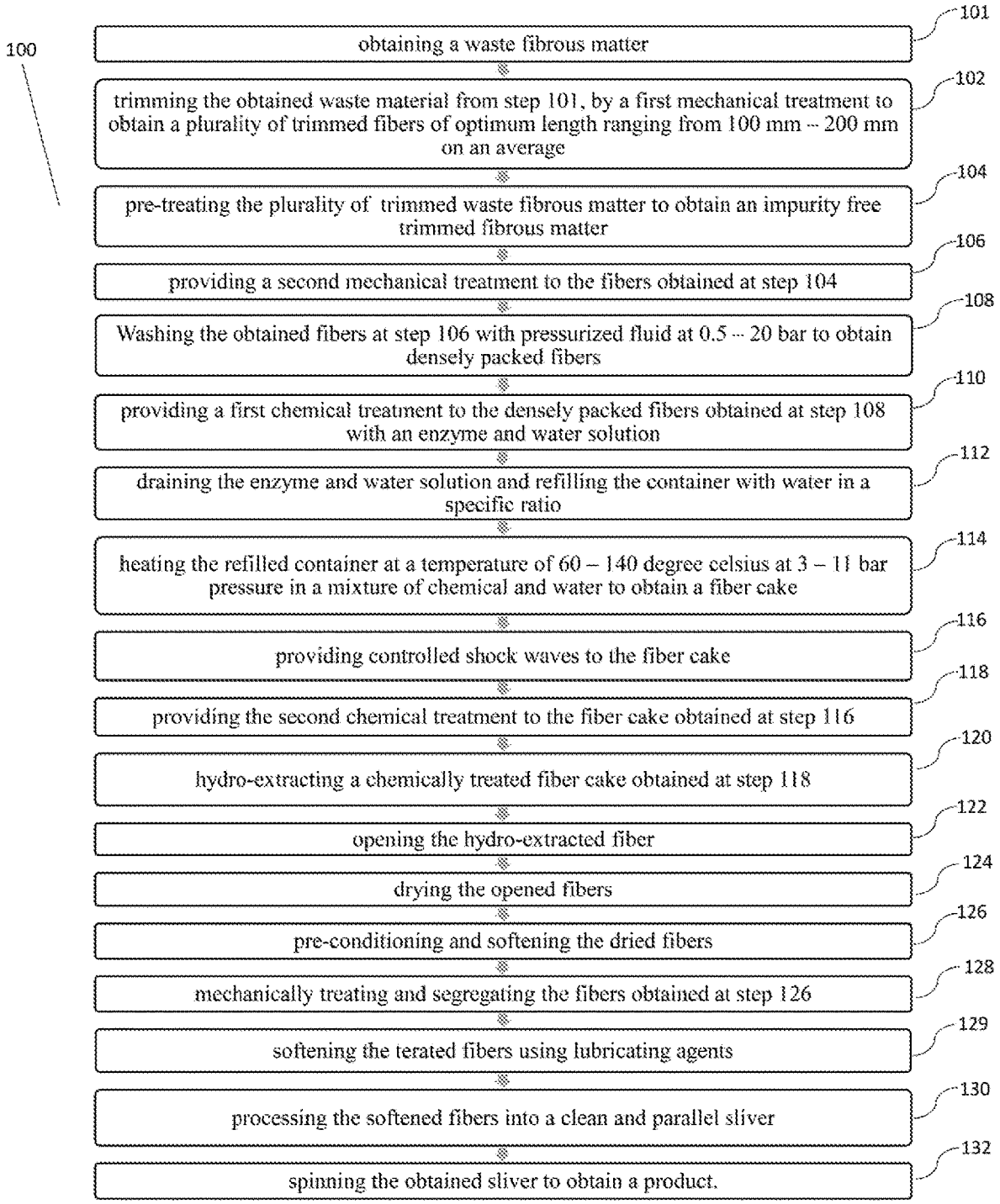
FIG. 1 illustrates a flowchart that depicts a method (100) of processing fibrous matter from waste material, according to an embodiment herein.

This section is intended to provide explanation and description of various possible embodiments of the present invention. The embodiments used herein, and the various features and advantageous details thereof are explained more fully with reference to non-limiting embodiments illustrated in the accompanying drawing/s and detailed in the following description. The examples used herein are intended only to facilitate understanding of ways in which the embodiments may be practiced and to enable the person skilled in the art to practice the embodiments used herein. Also, the examples/embodiments described herein should not be construed as limiting the scope of the embodiments herein.

As mentioned, there is a need for the development of a method that utilizes a fibrous matter from waste materials as well as employs a combination of chemical and mechanical methods to conserve resources, decrease carbon footprint, and contribute to sustainability.

The words "fibrous matter" and "fibers" have been used interchangeably throughout the draft.

The unit 'g/tex' stands for grams per tex, which is the force in grams required to break a bundle of fibers one tex unit in size.

A tex unit is equal to the weight in grams of 1000 meters of fiber.

The word mechanically treating and segregating refers to the process of separating individual fibers, using a series of dividing and redividing steps, that causes many of the fibers to lie parallel to one another while also removing most of the remaining impurities.

The present disclosure overcomes the limitations such as over consumption of fresh water, excess chemical usage, excess mechanical stress, low yield, low tensile strength, inconsistent length, and irregular alignments which cause wastage of resources while allowing for consistent and scalable infrastructure and processes that can allow for versatile kinds of lignocellulosic waste and natural fiber outputs.

The present method provides a cost effective and energy efficient method that has a low a relatively low carbon footprint to provide environment friendly products; having no synthetic fiber such as polyester that takes hundreds of years to degrade. The present method is easily scalable and adaptable in the already existing infrastructure of the industry and provides a sustainable alternative.

The present method transforms the agricultural waste from crops like Hemp Seed Oil, Pineapple, Nettle etc. and lignocellulosic fibrous waste from industry into natural fibers and yarns by preserving their natural form helps save chemicals, water, and energy. The present method utilizes non-hazardous chemicals, less water per kg of fiber produced and does not require regeneration of fibers which saves energy. The water used passes through effluent treatment plants and is reused. The natural fiber properties are further maintained and enhanced in the process.

In an embodiment herein, the present disclosure provides a method (100) to process the fibrous product from waste materials.

FIG. 1 illustrates a flowchart that depicts a method (100) of processing a fibrous matter from a waste material, according to an embodiment herein.

In the method (100), step (101) comprises obtaining the waste material.

The waste material includes but is not limited to biomass, waste products of vegetables and fruit plants, non-textile hemp, cannabis plants, pulses plants, cotton stalks, kenaf seed plants, oils, jute waste, palm waste, industrial wastes such as insulation, textiles, etc. The waste fibrous matter may include secondary, and tertiary waste of the non-textile bast plants apart from the primary waste. The waste fibrous matter are the lignocellulosic materials having lesser cellulose and fitness for textile graded fibers including wheat straw, rice straw, bagasse, palm, cotton stalk etc. The waste fibrous matter also includes retted or non-retted stalks and leaves. The waste fibrous matter can be in the form of rolls, bales, hanks, etc.

The method (100) further comprises, step (102) trimming the obtained fibrous matter from step (101) by a first mechanical treatment to obtain a plurality of trimmed fibers of optimum length ranging from 100 mm-200 mm on an average. In another embodiment, the mechanical treatment is done manually. In another embodiment, the mechanical treatment is done by a manual cutting machine, a round knife cutting machine, a straight knife cutting machine, a band knife cutting machine, a die cutting machine, a notcher machine, a drill cutting machine, a computerized cutting machine, a laser cutting machine, a water jet cutting machine, a rib cutting machine, an air jet cutting machine, an ultrasonic cutting machine, or a plasma torch cutting machine.

The method (100) further comprises (104) pre-treating the plurality of trimmed fibrous matter to obtain an impurity free trimmed fibrous matter. In another embodiment, pre-treatment (104) involves one or more of the traditional methods like retting, decorticating, extracting fibrous content through machines or manually.

In another embodiment, pre-treatment (104) involves dipping the obtained (101) waste fibrous matter in a mixture of enzyme and water for 0.5 hours to 5 days. In another embodiment, impurity free, well individualized fiber strands are obtained at step (104).

The method (100) further comprises step (106) for providing a second mechanical treatment (106) to the fibers obtained at step (104). In another embodiment the brittle, rigid, very short fibers are done away with at step (106).

The method (100) further comprises step (108), washing the obtained fibers at step (106) with pressurized fluid at 0.5-20 bar to obtain a densely packed fiber. The washing is carried out by techniques selected from the group comprising of an aqueous washing, a dry washing, a sand blasting, a whickering, a hand scrapping, a chemical spraying, a destroying, a pigment washing and a solvent based washing. In another embodiment, the solvent is selected from, not limited to, an alcohol, an acetone, alkali, acidic or an ethers. In another embodiment, the washing is achieved by an enzyme washing, a bleach washing, stone washing, an acid washing or a bleach-stone washing. In an embodiment, the fibers are packed in a pressurized carrier, a low-pressure carrier or a non-porous carrier. In an embodiment, the perforated carrier has a mesh.

The method (100) further comprises, step (110) for providing a first chemical treatment to the densely packed fibers obtained at step (108) with an enzyme and water solution. In an embodiment, the enzyme is a laccase. In an embodiment, the enzyme is a peroxidase. In an embodiment, the enzyme is a cellulases. In an embodiment, the enzyme is a pectinase. In an embodiment, the enzyme is a hemicellulases. In an embodiment, the enzyme is a cellulosome. In an embodiment, the enzyme is a xylanase. In an embodiment, the enzyme is an amylase. In an embodiment, the enzyme is selected from a combination of laccases, peroxidases, cellulases, pectinases, hemicellulases, cellulosomes, xylananse, or amylase. In another embodiment, first chemical treatment is carried out for 30 minutes to 5 days depending upon the nature of impurities. In an embodiment, enzyme producing bacteria and micro-organisms can be used in the chemical treatment. In another embodiment, the bacteria and micro-organisms consume the impurities in the waste material, The method (100) further comprises step (112), draining the enzyme and water solution and refilling the container with water in a specific ratio.

The method (100) further comprises step (114), heating the refilled container at a temperature of 60-140 degree Celsius at 3-11 bar in a mixture of chemical and water to obtain a fiber cake. The heating is achieved by techniques selected from the group comprising direct or indirect heating. The heating is achieved by techniques selected from the group comprising indirect steam, direct steam, water boiling, conduction, convection, radiation, and electro-magnetic heating. In another embodiment, the water is heated to 60-140 degree Celsius and subjected to steam explosions in regular intervals at 3-11 bar, 2-5 times for 10-300 seconds.

The method (100) further comprises step (116) providing controlled shockwaves to the fiber cake by draining and refiling the water. In another embodiment, the shockwaves using controlled injection of direct steam, ultrasound, indirect heat, steam guns, chemical reactions, etc. and the pressure inbuilt is also release at speed through automatic or manual valves embedded in the vessel. In another embodiment the shockwaves are provided mechanically through shaking.

The method (100) further comprises step (118), optionally providing a second chemical treatment to the fiber cake depending upon the physical and chemical properties of the waste material. chemical treatment is carried out by a group of chemicals comprising acid/s, alkali/s, alcohol/s, and oxidizing agents. In another embodiment, chemical treatment is preceded by acidic or basic pickling depending upon the type of waste.

The method (100) further comprises step (120), hydro-extracting a chemically treated fiber cake to remove excess water. The hydro-extraction is carried out by a group of machines comprising a belt driven and a motor driven hydroextractor, using centrifugal or hydraulic forces.

The method further comprises step (122), opening the hydro-extracted fiber cake obtained at step (120) to fiber strands or small clusters.

In an embodiment the filter cake from step (122) is optionally subjected to a softening treatment using a group of softening agents comprising a cationic softener, an anionic softener, a non-ionic softener, a reactive softener, an amphoteric softener and a silicon softener.

The method further comprises step (124), drying the hydro-extracted cake using radio waves to further reduce the average moisture level. The drying is carried out by a group of techniques comprising direct or indirect heating. The drying is carried out by a group of techniques comprising of steam, direct convection, convection, conduction, radiation, and electro-magnetic heating.

The method further comprises step (126), pre-conditioning and softening the dried fibers. Pre-conditioning and softening are carried out using enzymes, natural oil, lubricating oils, spinning oils, batching oils, cohesion oils, anti-friction and reducing oils. In another embodiment, the method (100) further comprises classifying the softened and preconditioned fibers obtained after step (126) on the basis of physical and chemical properties thereof, using mechanical segregation methods.

The method further comprises step (128), mechanically treating and segregating the dried product. These mechanical treatments involving cleaning, opening, making fibre parallel, surface enhancing, inconsistency reducing (128) is carried out by a group of machines comprising dual carding machine, a mono or single carding machine, a tandem carding machine, a Schubert & Sulzer super carding machine, a roller and clearer carding machine, a stationary flat carding machine, and revolving flat carding machine and/or fibre cleaners, openers, blow room actions The method (100) further comprises step (129), softening the treated fibers using lubricating agents. In an embodiment, softening is carried out by a group comprising but not limited to softening agents, impurities digester, friction reducing agents, and cohesiveness enhancing agents.

The method (100) further comprises step (130), processing the softened fiber into a clean and parallel sliver. In another embodiment, processing includes cleaning, parallelly arranging, reducing inconsistency of fiber by removing highly varied fibers, and removing short and weak fibers. In an embodiment, cutting and bailing of the sliver is done post processing (130).

The method (100) further comprises step (132), spinning the sliver to obtain a product. The spinning is carried out by a group of techniques comprising ring spinning, a rotor spinning, a friction spinning, a self-twist spinning, an electro-static spinning, a vortex spinning, an air-jet spinning, a twist-less spinning, a wet spinning, a dry spinning, a melt spinning, a bi-component spinning, a film-splitting reaction spinning, an integrated composite spinning, a cover spun spinning, selfil yarn spinning, or acro-dynamic spinning.

In another embodiment, wherein the product in method (100) consists of woven products, non-woven products, knitted products, composites, nano fibers.

Figure 2:
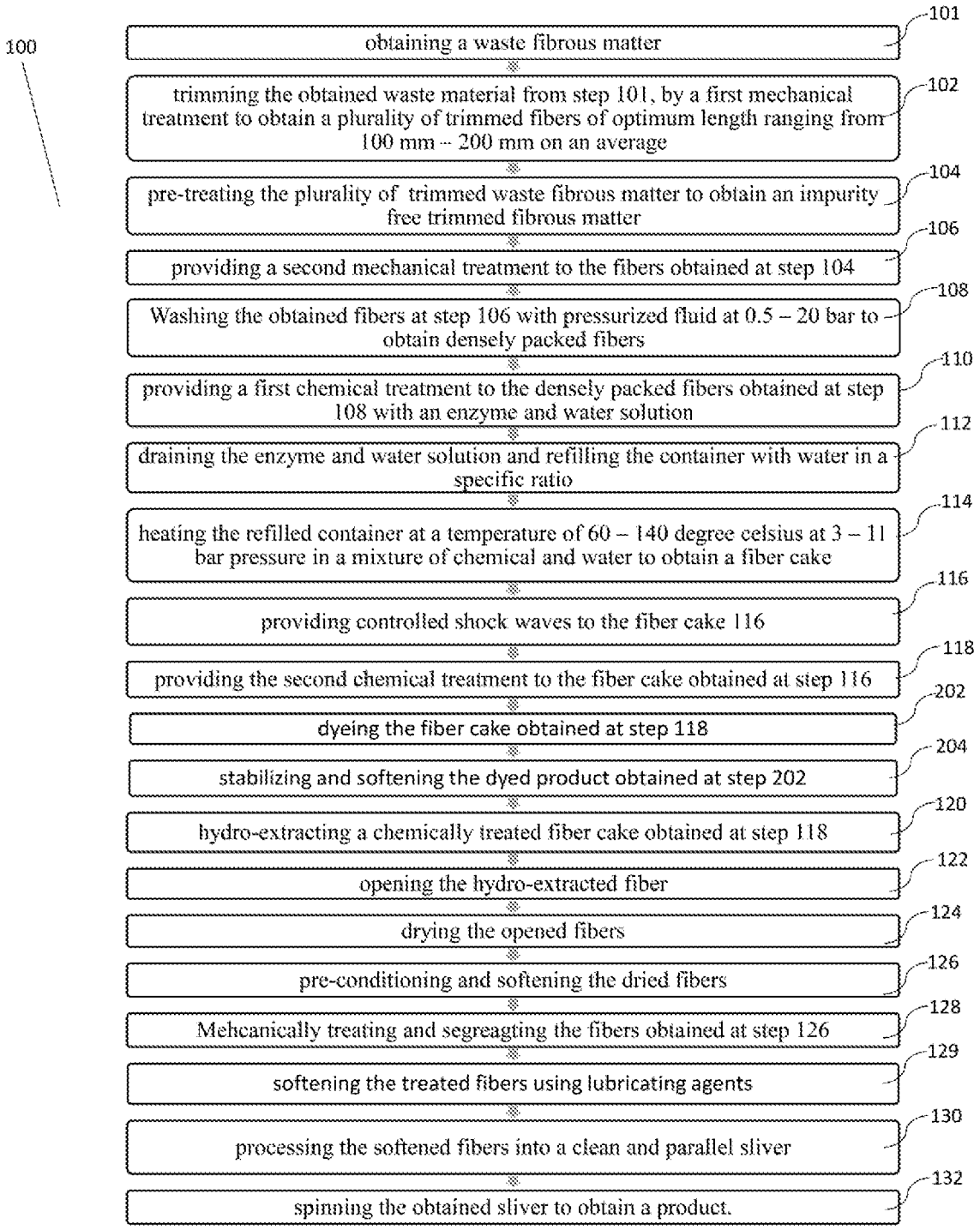
FIG. 2 illustrates a flowchart that depicts another method (200) of processing fibrous matter from waste material, according to an embodiment herein.

FIG. 2 illustrates a flowchart that depicts another method (200) of processing a fibrous matter from a waste material, according to an embodiment herein.

In another embodiment, another method (200) for processing fibrous matter from a waste material to obtain a product, is provided.

The method (200) comprising obtaining (101) a waste material. The method (200) further comprises step (102), trimming the obtained waste material from step (101) by a first mechanical treatment, to obtain a plurality of trimmed fibers of optimum length ranging from 100 mm-200 mm on an average. The method (200) further comprises step (104), pre-treating the trimmed waste fibrous matter to obtain an impurity free trimmed fibrous matter. The method (200) further comprises step (106), providing a second mechanical treatment to the fibers obtained at step (104). The method (200) further comprises step (108), washing (108) the obtained fibers at step (106) with pressurized fluid at 0.5-20 bar to obtain a densely packed fiber. The method (200) further comprises step (110), providing a first chemical treatment to the densely packed fibers obtained at step (108) with an enzyme and water solution. The method (200) further comprises step (112) draining the enzyme and water solution from the fibers obtained at step (108) and refilling the container with water in a specific ratio. The method (200) further comprises step (114), heating the refilled container at a temperature of 60-140 degree Celsius at 3-11 bar in a mixture of chemical and water to obtain a fiber cake. The method (200) further comprises step (116), providing controlled shock waves to the fiber cake by draining and refilling the water. The method (200) further comprises step (118), optionally providing a second chemical treatment to the obtained fiber cake at step (116). The method (200) further comprises step (202), dyeing the fiber cake obtained at step (118). The method (200) further comprises step (204), stabilizing the dyed product obtained at step (202). The method (200) further comprises step (120), hydro-extracting the stabilized product obtained at step (204). The method (200) further comprises step (122), opening the hydro-extracted fiber cake obtained at step (120). The method (200) further comprises step (124), drying the opened fiber obtained at step (122). The method (200) further comprises step (126), pre-conditioning and softening the dried fibers. The method (200) further comprises step (128), mechanically treating and segregating the fibers obtained at step (126). The method (200) further comprises step (129), softening the treated fibers using lubricating agents. The method (200) further comprises step (130), processing the softened fiber into a clean and parallel sliver, and spinning (132) the obtained sliver obtain a product.

In another embodiment, all or either of the bath options A, B, C, and D for chemical treatment can be chosen depending upon the type of waste matter. In another embodiment, one or more sub-steps of bath options A, B, C, and D can be chosen for chemical treatment depending upon the type of waste matter or the fibrous matter.

In another embodiment, the sequence of steps in method (100) can be changed depending upon the waste matter procured or the product being manufactured.

In another embodiment, the sequence of steps in method (200) can be changed depending upon the waste matter procured or the product being manufactured.

In the above embodiments, the water circulated through particular vessels or columns or chambers or any waste water may be recirculated to generate energy after extracting lignin to make lignin blended products therefrom. Further, all waste fibres, not suitable for primary objective are also recollected to be used for secondary objective and is plugged in for next best industrial applications. These make the present method more sustainable, circular, energy efficient, and closed loop.

The fibrous matter processed from the above methods has improved quality as they have reduced denier, increased consistency in length and denier, controlled average length variations. The fibrous matter has increased softness and better structure as compared to that of the existing fibers without losing strength, better chemical composition, and better dyeability. In addition, the functional properties such as air permeability, anti-UV, anti-bacterial, and so on persist therein. Hence, the yarn produced from the fibers may have higher possibility of blend, cohesiveness with other fibers and materials, lesser IPI (Imperfection Index; including naps), higher CSP/RKM. The yarn produced may have a greater number of counts, producing spinning of both thick and fine yarns, and higher compatibility with different kinds of spinning systems.

EXAMPLES

The examples will be readily apparent to those skilled in the art, the present embodiment may easily be produced in other specific forms without departing from its essential characteristics. The present examples are, therefore, to be considered as merely illustrative and not restrictive, the scope being indicated by the claims rather than the foregoing description, and all changes which come within therefore intended to be embraced therein

Example 1

Waste fibrous materials were pretreated to remove all the impurities. The impurity free waste fibrous matter was then subjected to trimming using mechanical treatment to obtain fibers of length 200 mm-100 mm, or as per need. Subjected the obtained fibers to a mechanical treatment to loosen and clean the fibers. The fibers are then thorough washed during and while being densely packed into a perforated carrier with fluidized pressure. The carrier packed densely with fibers is then placed into a vessel having enzyme and water solution. The process is carried out for 30 minutes depending upon the nature of impurities. The fibrous materials: water:enzyme ratio is on an average 1:3.3:0.015. The water is then drained and filled with new water at an average of fiber to water ratio of 1:2.8. The water is heated to 80 degree Celsius and subjected to steam explosions in regular intervals at 15 bar, 5 times for 120 seconds. The fiber water cake is then ready for chemical treatment, where either of the one process is performed depending upon the chemical constituents of the raw material, mechanical land physical properties. A step of dyeing and stabilizing the fiber can be done at this step if needed. The obtained white solidified cake is then placed into a hydroextractor to reduce the average moisture content to 30%. The densely packed cake is then opened mechanically to break it back into fibers. The fiber with moisture is then subjected to Radio frequency to reduce the average moisture level to around 10%. The fibers are assessed at this stage for its chemical properties, physical properties and softness. Based on results the fibers are then exposed to specially designed short bast softening machine that smoothens the surface and sprays it with enzyme or oil-based or wax-based emulsifier/lubricant. The fibers are the passed-through a mechanical machines having set of wires and directional openers for removal of lint, further softening and parallelization of fibers. If the application requires blending of any fibers, then the blends can be made at this stage. If there is a need to manipulate the length, then the parallel fiber sliver is cut in desired length as per application with highest consistency. If not, the slivers can be used directly to be spun into yarn.

The chemical treatment in the above method comprises of:

a) Bath treatment A wherein if the waste material is high in cellulosic content, only one bath treatment is done. In this treatment an oxidizing agent with a catalyst is used or an alkali treatment is done for 2 hours. The same is neutralized and softened in the same batch with acid and treated with an enzyme solution.

b) Bath B treatment wherein if the waste material is average rigid and has a high lignin concentration, double alkali treatment is done. Bath treatment A along with softening treatment is performed after draining the water after first alkali treatment.

c) Bath treatment wherein if the waste is very rigid and has even higher lignin content, bath treatment B is conducted. if the waste material is average rigid and has a high lignin concentration, double alkali treatment is done. Bath treatment A along with softening treatment is performed after draining the water after first alkali treatment in separate baths.

d) Bath treatment D wherein if the waste is highly rigid and has extremely high lignin content. the alkali treatment is done twice, one with and one without bleaching agent along with softening treatment.

In case of higher impurities any of the below is preceded by pickling.

All or either of the bath options A, B, C, and D can be chosen depending upon the type of waste matter. This the case for the sub-steps of these bath options as well i.e., one of the sub-steps or all of the sub-steps can be chosen as well. The choice of treatment purely depends upon the type of waste matter or the fibrous matter.

TABLE 1

The below table shows types of chemical treatment in brief and steps involved therein.

| Sr. No. | Types of Chemical Processing | Steps involved in each of the Types |
|---|---|---|
| 1 | Bath Treatment A | Use of bleaching agent with or without hydrochloric acid with optimum combination of oxidizing catalyst to build free radicals to achieve desired quality of fibers.<br>Use of Alcohol with catalyzing agent to achieve the same as above.<br>Alkali Treatment (followed by neutralizing)<br>Enzyme treatment |
| 2 | Bath Treatment B | Bath Treatment A + Softening treatment<br>Bath Treatment A + Hot water wash<br>Two alkali treatments (would be followed by neutralizing)<br>Enzyme + alkali treatment |
| 3 | Bath Treatment C | Bath Treatment A + Bath Treatment B + non-chemical technologies<br>Bath Treatment A + Bath Treatment B + hot water |
| 4 | Bath Treatment D | Bath Treatment C + Softening treatment |

Example 2

Waste fibrous materials were pretreated to remove all the impurities. The impurity free waste fibrous matter was then subjected to trimming using mechanical treatment to obtain fibers of length 100 mm, or as per need. Subjected the obtained fibers to a mechanical treatment to loosen and clean the fibers. The fibers are then thorough washed during and while being densely packed into a perforated carrier with fluidized pressure. The carrier packed densely with fibers is then placed into a vessel having enzyme and water solution. The process is carried out for 30 minutes depending upon the nature of impurities. The fibrous materials:water:enzyme producing microbes ration is on an average 1:4:0.02. The water is then drained and filled with new water at an average of fiber to water ratio of 1:3.2. The water is heated to 110 degree Celsius and subjected to steam explosions in regular intervals at 8 bar, 3 times for 220 seconds. The fiber water cake is then ready for chemical treatment, where either of the one process is performed depending upon the chemical constituents of the raw material, mechanical land physical properties. A step of dyeing and stabilizing the fiber can be done at this step if needed. The obtained white solidified cake is then placed into a hydroextractor to reduce the average moisture content to 40%. The densely packed cake is then opened mechanically to break it back into fibers. The fiber with moisture is then subjected to Radio frequency to reduce the average moisture level to around 20%. The fibers are assessed at this stage for its chemical properties, physical properties and softness. Based on results the fibers are then exposed to specially designed short bast softening machine that smoothens the surface and sprays it with enzyme or oil-based or wax-based emulsifier/lubricant. The fibers are the passed-through a mechanical machine with set of wires, openers, felts for removal of lint, further softening and parallelization of fibers. If the application requires blending of any fibers, then the blends can be made at this stage. If there is a need to manipulate the length, then the parallel fiber sliver is cut in desired length as per application with highest consistency. If not, the slivers can be used directly to be spun into yarn.

TABLE 2

The table below shows resource consumption and other comparison criteria for our method versus conventional methods.

| FEATURES | Results From The Present Method As Compared To Traditional fibers And Methods | Source of data for traditional fibers taken for comparison |
|---|---|---|
| Blue Water Consumption (In litres/kg of Fiber) | Saves more than 99.5% as compared to cotton | Cotton inc 2016 |
| Fresh Water Consumption (aka Water use in litres/kg of fiber) | Saves more than 99% as compared to cotton | MISTRA Fiber Bible part 2 report averages on water depletion and water usage |
| Primary Energy demand (non-renewable MJ/kg of Fiber) | Saves more than 90% as compared to cotton and PET | Ecoinvent 3.3 (Gabi) |
| Global warming potential 100(kg $CO^2$ equivalent/kg of fiber) | Saves more than 80%, 90%, and 70% than cotton, flax and lyocell respectively | MISTRA Fiber Bible part 2 report averages |
| Acidification potential (kg $SO^2$ equivalent/kg of fiber) | Saves more than 75% and 85% than cotton and viscose respectively | Cotton inc 2012 Lenzinger berichte 88 (2010) |
| Eutrophication potential (kg $PO^4$ equivalent/kg of fiber) | Saves more than 80% and 69% than cotton and viscose respectively | Cotton inc 2012 Lenzinger berichte 88 (2010) |
| Human Toxicity Potential (kg DCB equivalent/kg of Fiber) | 0.0308 | Shen et al. 2010a |

TABLE 3 depicts the comparison further for clear indication:

| Comparison criteria of usage of resources in the present method | Avg. Consumption in the present method for 1 kg of spinnable fibres | Consumption of the resources for traditional fibres or methods. |
|---|---|---|
| Blue Water Consumption (In liters/ kg of fiber) | 0.9816 | Cotton consumes 1560, i.e., 1589.2 times water per kg of fiber (Cotton Inc 2016) |
| Fresh Water Consumption (Aka water use In liters/ kg of | 15.2901 | Cotton uses 4800, i.e., 313.9 times<br>Flax uses 300, i.e., 19.6 times<br>Hemp uses 3200 i.e., 209 times<br>Wool uses 500 i.e., 32.7 times<br>Viscose uses 400 i.e., 26.16 times<br>Lyocell use 300 i.e., 19.6 times<br>Pet fibers use 100 i.e., 6.5 times<br>(MISTRA Fiber Bible part 2 report averages on water depletion and water usage) |
| Global Warming Potential 100 (kgCo2 equivalent/ kg of fiber) | 0.4050 | Cotton has 2.2, i.e., 5.4 times<br>Flax has 8.6, i.e., 21.2 times<br>Hemp has 3.1, i.e., 7.65 times<br>Wool has 16.8, i.e., 41.48 times<br>Viscose has 3.8, i.e., 9.38 times<br>Lyocell use 1.5 i.e., 3.7 times<br>Pet fibers use 3.3, i.e., 8.15 times<br>(MISTRA Fiber Bible part 2 report averages) |
| Primary Energy demand (non-renewable MJ/kg of Fiber) | 6.9652 | Cotton takes 79.1, i.e., 11.35 times<br>Wool takes 166, i.e., 23.83<br>Jute takes 52.7, i.e., 7.6 times<br>Viscose takes 78.6 i.e., 11.28 times<br>Pet Fiber takes 108, i.e., 15.5 times<br>Nylon Takes 128, i.e., 18.4 times<br>(Ecoinvent 3.3 (Gabi)<br>Ecoinvent 3.3 (Gabi)<br>Ecoinvent 3.3 (Gabi)<br>Ecoinvent 3.3 (Gabi)<br>Professio GaBi Databas3 8.7<br>GaBi Database) |

Results: The above results clearly indicates that the effectiveness of the present method of the existing methods.

The final product is analyzed/tested for its chemical, physical, and mechanical properties. The properties include cellulose, lignin, hemicellulose and other percent composition; average length, strength, fineness, variation and consistency percentage, elongation, moisture percentage.

Results According to a Preferred Embodiment

Cellulose percentage: 87-91%
Length: 75 mm (on an average)
Strength: 42 g/tex
Elongation: 5%
Mic (fineness): 5-7
Moisture percentage: 12%

The fabrics or final applications tested from this fibre include carpets, trousers, shirts, blazers, t-shirts, home textiles, non-wovens etc.

While the disclosure has been presented with respect to certain specific embodiments, it will be appreciated that many modifications and changes may be made by those skilled in the art without departing from the spirit and scope of the disclosure. It is intended, therefore, by the appended claims to cover all such modifications and changes as fall within the true spirit and scope of the disclosure.

I claim:

1. A method for processing fibrous matter from a waste fibrous material to obtain a product, the method comprising:

a) obtaining the waste fibrous material;

b) trimming the obtained waste fibrous material from step a) by a first mechanical treatment, to obtain a plurality of trimmed fibers of optimum length ranging from 100 mm-200 mm on an average;

c) pre-treating the plurality of trimmed waste fibrous matter to obtain an impurity free trimmed fibrous matter;

d) providing a second mechanical treatment to the fibers obtained at step c);

e) washing the obtained fibers at step d) with fluidized pressure at 0.5-20 bar pressure to obtain a densely packed fibers;

f) providing a first chemical treatment to the densely packed fibers obtained at step e) with an enzyme and water solution;

g) draining the enzyme and water solution from the fibers obtained at step f) and refilling a container with water in a specific ratio;

h) heating the refilled container at a temperature of 60-140 degree Celsius at 3-11 bar in a mixture of chemical and water to obtain a fiber cake;

i) providing controlled shock waves to the fiber cake; and/or providing a second chemical treatment to the fiber cake obtained at step h);

j) hydro-extracting the chemically treated fiber cake obtained at step i);

k) opening the hydro-extracted fiber cake;

l) drying the opened fibers;

m) pre-conditioning and softening the dried fibers;

n) mechanically treating and segregating the fibers obtained at step m);

o) softening the treated fibers using lubricating agents;

p) processing the softened fiber into a clean and parallel sliver; and q) spinning the obtained sliver to obtain a product.

2. The method of claim 1, further comprises of a dyeing and a stabilizing step that can be done before the hydro-extraction.

3. The method of claim 1, further comprises blending before step 1) with the fibers comprising cotton, wool, jute, rayon, silk, hemp, alpaca fiber, polyester, and lyocell.

4. The method of claim 1, wherein the waste fibrous materials are selected from a group comprising bales, rolls, hanks, vegetable, plant, non-textile hemp, jute waste, palm waste, textile waste, lignocellulosic materials, wheat straw, rice straw, bagasse, cotton stalk, retted stalks, retted leaves and non-retted stalks.

5. The method of claim 1, wherein the first mechanical treatment is carried out from a group of machines selected from a manual cutting machine, round knife cutting machine, straight knife cutting machine, band knife cutting machine, die cutting machine, notcher machine, drill cutting machine, computerized cutting machine, laser cutting machine, water jet cutting machine, rib cutting machine, air jet cutting machine, ultrasonic cutting machine, and plasma torch cutting machine.

6. The method of claim 1, wherein the enzyme at step f) is selected from a group of enzymes comprising laccases, peroxidases, cellulases, pectinases, hemicellulases, amylases, xylanase, or cellulosomes.

7. The method of claim 1, wherein the chemical treatment is carried out for 0.5-72 hours.

8. The method of claim 1, wherein drying is done by radio frequency to reducing the moisture to 10-30%.

9. The method of claim 1, wherein the mechanical treatment and segregation is done by a dual carding machine, a mono or single carding machine, a tandem carding machine, a roller and clearer carding machine, a stationary flat carding machine, or revolving flat carding machine and/or fibre cleaners, openers, blow room actions.

10. The method of claim 1, further comprises cutting and bailing if needed after step p).

11. The method of claim 1, further comprises classifying the softened and preconditioned fibers obtained after step m) on the basis of physical and chemical properties thereof, using mechanical segregation methods.

12. The method of claim 1, wherein processing includes cleaning, parallelly arranging, reducing inconsistency of fiber by removing highly varied fibers, and removing short and weak fibers.

13. The method of claim 1, wherein the product consists of woven products, non-woven products, knitted products, composites, nano fibers, micronized fibers.

14. A method for processing fibrous matter from a waste fibrous material to obtain a product, the method comprising:

a) obtaining the waste fibrous material;

b) trimming the obtained waste fibrous material from step a) by a first mechanical treatment, to obtain a plurality of trimmed fibers of optimum length ranging from 100 mm-200 mm on an average;

c) pre-treating the plurality of trimmed fibrous matter to obtain an impurity free trimmed fibrous matter;

d) providing a second mechanical treatment to the fibers obtained at step c);

e) washing the obtained fibers at step d) with pressurized fluid at 0.5-20 bar to obtain a densely packed fibers;

f) providing a first chemical treatment to the densely packed fibers obtained at step e) with an enzyme and water solution;

g) draining the enzyme and water solution from the fibers obtained at step f) and refilling a container with water in a specific ratio;

h) heating the refilled container at a temperature of 60-140 degree Celsius at 3-11 bar in a mixture of chemical and water to obtain a fiber cake;

i) providing controlled shock waves to the fiber cake; and/or providing a second chemical treatment to the obtained fiber cake at step h);

j) dyeing the fiber cake obtained at step i);

k) stabilizing and softening the dyed product obtained at step j);

l) hydro-extracting the stabilized product obtained at step k);

m) opening the hydro-extracted fiber cake;

n) drying the opened fibers;

o) pre-conditioning and softening the dried fibers;

p) mechanically treating and segregating the fibers obtained at step o);

q) softening the treated fibers using lubricating agents;

r) processing the softened fiber into a clean and parallel sliver with; and s) spinning the obtained sliver to obtain a product.

* * * * *